US009289064B2

(12) United States Patent
LaMontagne et al.

(10) Patent No.: US 9,289,064 B2
(45) Date of Patent: Mar. 22, 2016

(54) SHELF STRUCTURE FOR A MERCHANDISER

(71) Applicant: Hussmann Corporation, Bridgeton, MO (US)

(72) Inventors: Rick M. LaMontagne, Warrenton, MO (US); Tom Wind, Bridgeton, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 14/205,471

(22) Filed: Mar. 12, 2014

(65) Prior Publication Data

US 2014/0263114 A1 Sep. 18, 2014

Related U.S. Application Data

(60) Provisional application No. 61/777,915, filed on Mar. 12, 2013.

(51) Int. Cl.
*A47G 29/00* (2006.01)
*A47F 5/00* (2006.01)
(Continued)

(52) U.S. Cl.
CPC ..... *A47B 96/021* (2013.01); *A47B 47/022* (2013.01); *A47B 96/027* (2013.01); *A47B 96/028* (2013.01); *A47F 5/0043* (2013.01); *A47F 5/103* (2013.01)

(58) Field of Classification Search
CPC ..... A47B 96/02; A47B 96/024; A47B 96/06; A47B 96/061; A47B 96/063; A47B 96/066; A47B 96/067; A47B 96/14; A47B 96/145; A47B 57/00; A47B 57/06; A47B 57/30; A47B 47/02; A47B 47/021; A47B 47/022; A47F 5/00; A47F 5/0018; A47F 5/0043; A47F 5/08; A47F 5/101; A47F 5/103; A47F 3/04; A47F 3/0439; A47F 3/06; A47F 3/063; A47F 3/0426; F25D 25/02; F25D 25/022; F25D 25/024; F25D 2325/022
USPC ..... 211/71.01, 193, 90.01–90.04, 134, 135; 312/408, 116, 128, 126; 108/106–108; 248/235, 243
See application file for complete search history.

(56) References Cited

U.S. PATENT DOCUMENTS 2,976,003 A 3/1961 Foster
3,130,693 A 4/1964 Shell
(Continued)

FOREIGN PATENT DOCUMENTS

EP 0111473 6/1984
JP H07298963 11/1995
(Continued)

OTHER PUBLICATIONS

Patent Examination Report No. 1 from IP Australia for Application No. 2014201414 dated May 14, 2015 (6 pages).

*Primary Examiner* — Jennifer E Novosad
(74) *Attorney, Agent, or Firm* — Michael Best & Friedrich LLP

(57) ABSTRACT

A shelf for a merchandiser. The shelf includes a skin that defines a support surface of the shelf, and a skeleton structure to which the skin is attached. The skeleton structure includes a first end bracket and a second end bracket that is spaced from and disposed opposite the first end bracket. The skeleton structure further includes an internal bracket that has a first end coupled to the first end bracket adjacent a rear end of the first end bracket, and a second end coupled to the second end bracket adjacent a rear end of the second end bracket. The internal bracket extends forward from the respective rear ends toward a front of the shelf.

20 Claims, 10 Drawing Sheets

(51) Int. Cl.

| | |
|---|---|
| ***A47B 96/02*** | (2006.01) |
| ***A47F 5/10*** | (2006.01) |
| ***A47B 47/02*** | (2006.01) |

(56) References Cited

U.S. PATENT DOCUMENTS

| | | | | | |
|---|---|---|---|---|---|
| 3,556,306 | A | * | 1/1971 | Shell | 211/90.02 |
| 3,765,344 | A | * | 10/1973 | Ferdinand et al. | 108/108 |
| 3,845,864 | A | | 11/1974 | Heinrich | |
| 4,064,813 | A | | 12/1977 | Hewett et al. | |
| 4,240,557 | A | | 12/1980 | Dickens | |
| 4,407,476 | A | * | 10/1983 | Bohannan | 248/235 |
| 4,535,898 | A | | 8/1985 | Jones et al. | |
| 4,709,642 | A | * | 12/1987 | Briosi | 108/187 |
| 4,881,708 | A | | 11/1989 | Walter | |
| 5,022,529 | A | * | 6/1991 | Kang | 206/581 |
| 5,188,246 | A | | 2/1993 | Maxworthy | |
| 5,273,354 | A | * | 12/1993 | Herrmann et al. | 312/408 |
| 5,322,174 | A | | 6/1994 | Wolters | |
| 5,348,384 | A | * | 9/1994 | Hull et al. | 312/140.3 |
| 5,405,114 | A | * | 4/1995 | Dias | 248/250 |
| 5,441,338 | A | * | 8/1995 | Kane et al. | 312/408 |
| 5,573,322 | A | | 11/1996 | Worbel | |
| 5,577,623 | A | * | 11/1996 | Bustos | 211/187 |
| 5,893,470 | A | * | 4/1999 | Peggs | 211/90.01 |
| 6,021,908 | A | * | 2/2000 | Mathews | 211/90.02 |
| 6,164,610 | A | * | 12/2000 | Santiago | 248/235 |
| 6,189,707 | B1 | * | 2/2001 | Meyers et al. | 211/90.04 |
| 6,505,442 | B2 | * | 1/2003 | Banicevic et al. | 49/501 |
| 6,811,045 | B1 | * | 11/2004 | Masker et al. | 211/153 |
| 7,237,856 | B2 | | 7/2007 | Bienick et al. | |
| 7,347,336 | B1 | * | 3/2008 | Williams et al. | 211/153 |
| 7,918,516 | B2 | * | 4/2011 | Decker et al. | 312/116 |
| 8,960,827 | B2 | * | 2/2015 | McMillin et al. | 312/408 |
| 2006/0145577 | A1 | * | 7/2006 | Daley et al. | 312/408 |
| 2010/0026156 | A1 | | 2/2010 | Leconte et al. | |
| 2012/0031864 | A1 | | 2/2012 | Wasson et al. | |
| 2012/0285915 | A1 | * | 11/2012 | O'Quinn et al. | 211/134 |
| 2012/0292277 | A1 | | 11/2012 | Chikkakalbalu | |
| 2014/0217046 | A1 | * | 8/2014 | Wang | 211/134 |

FOREIGN PATENT DOCUMENTS

| | | |
|---|---|---|
| JP | 2005334261 | 12/2005 |
| WO | 95/29613 | 11/1995 |

* cited by examiner

SHELF STRUCTURE FOR A MERCHANDISER

BACKGROUND

The present invention relates to shelves for a merchandiser, and more particularly to a shelf skeleton of the shelf.

Existing shelves typically include heavy gauge steel support brackets on each end and reinforcing members that extend laterally between the support brackets. A flat sheet typically overlays the brackets and the lateral support members to provide a uniform support surface. In conventional practice, the weight that can be supported by a particular shelf significantly depends on the cross-sectional area of the lateral support members. In upright merchandisers, the support brackets typically attach to vertically-oriented shelf standards to provide support for items placed on the shelf. Existing shelf standards are often spaced apart from each other by a predefined distance that correlates to the width of the shelf to be installed in the merchandiser.

SUMMARY

In one construction the invention provides a shelf for a merchandiser. The shelf includes a skin that defines a support surface of the shelf, and a skeleton structure to which the skin is attached. The skeleton structure includes a first end bracket and a second end bracket that is spaced from and disposed opposite the first end bracket. The skeleton structure further includes an internal bracket that has a first end coupled to the first end bracket adjacent a rear end of the first end bracket, and a second end coupled to the second end bracket adjacent a rear end of the second end bracket. The internal bracket extends forward from the respective rear ends toward a front of the shelf.

In another construction, the invention provides a shelf including a skeleton structure that has a first end bracket and a second end bracket spaced from and disposed opposite the first end bracket. The skeleton structure further includes a front bracket coupled to and extending between forward ends of the first and second end brackets. The skeleton structure also includes an internal bracket extending parallel to the end brackets and coupled to the front bracket between the end brackets.

In another construction, the invention provides a merchandiser including a case that has a rear wall and a product display area partially defined by the rear wall, and a shelf coupled to the rear wall. The shelf has a skin defining a support surface of the shelf, and a skeleton structure adhered to the skin. The skeleton structure has a first end bracket and a second end bracket spaced from and disposed opposite the first end bracket, and the skeleton structure further has a rear bracket extending between and directly coupled to the first and second end brackets, and an internal bracket coupled to and extending forward from the rear bracket.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
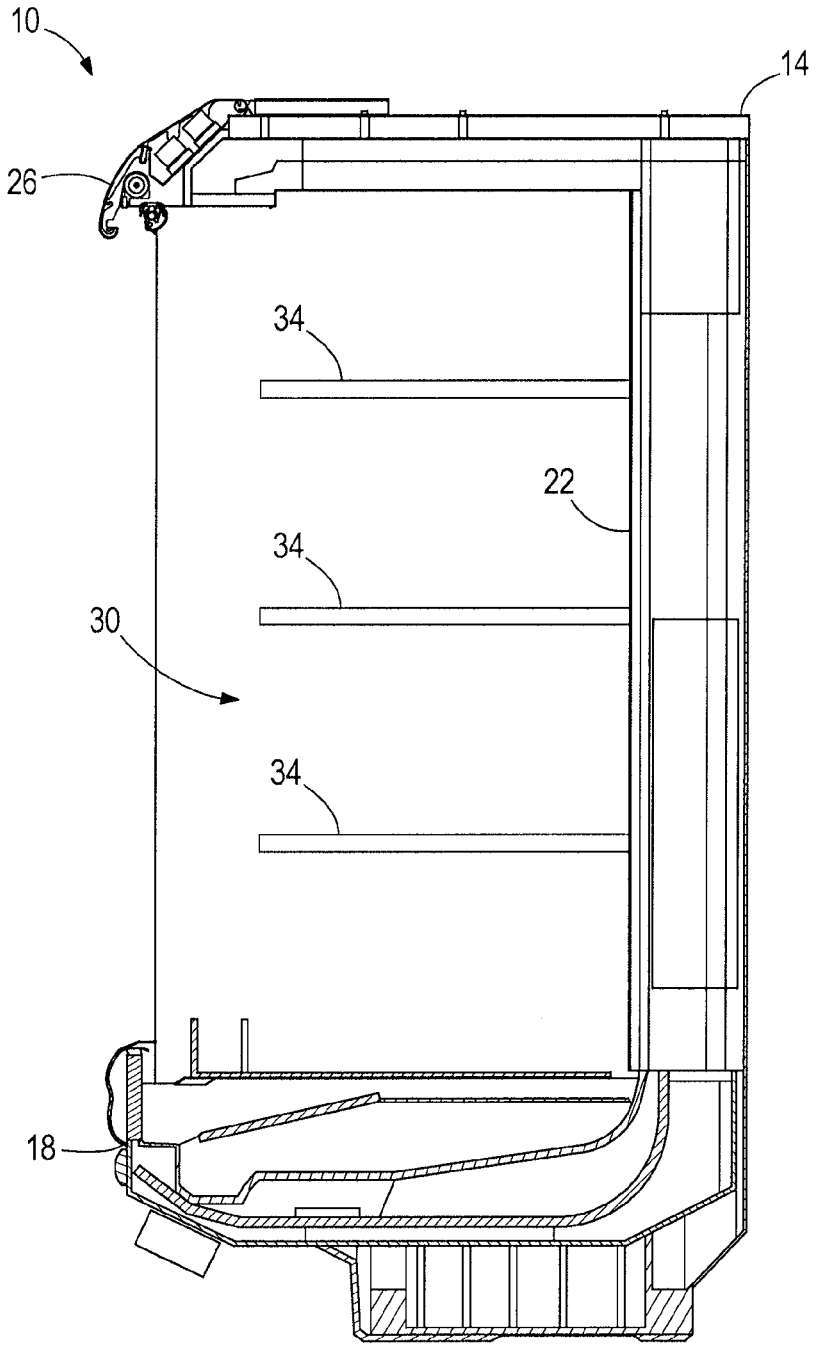
FIG. 1 is a section view of a merchandiser including shelves embodying the invention.

FIG. 1 illustrates one construction of a refrigerated merchandiser 10 that may be located in a supermarket or a convenience store or other retail setting (not shown) for presenting fresh food, beverages, and other product (not shown) to consumers. The illustrated refrigerated merchandiser 10 includes a case 14 that has a base 18, a rear wall 22, and a canopy 26. The area partially enclosed by the base 18, the rear wall 22, and the canopy 26 defines a product display area 30 in which food product can be supported on shelves 34 and accessed from adjacent a front of the case 14 (e.g., on shelves). As illustrated, the shelves 34 are positioned in an upright merchandiser 10 with an open front, although the shelves 34 can be coupled to other styles of merchandisers. Although not shown, doors can be used to enclose the product display area 30.

Figure 2:
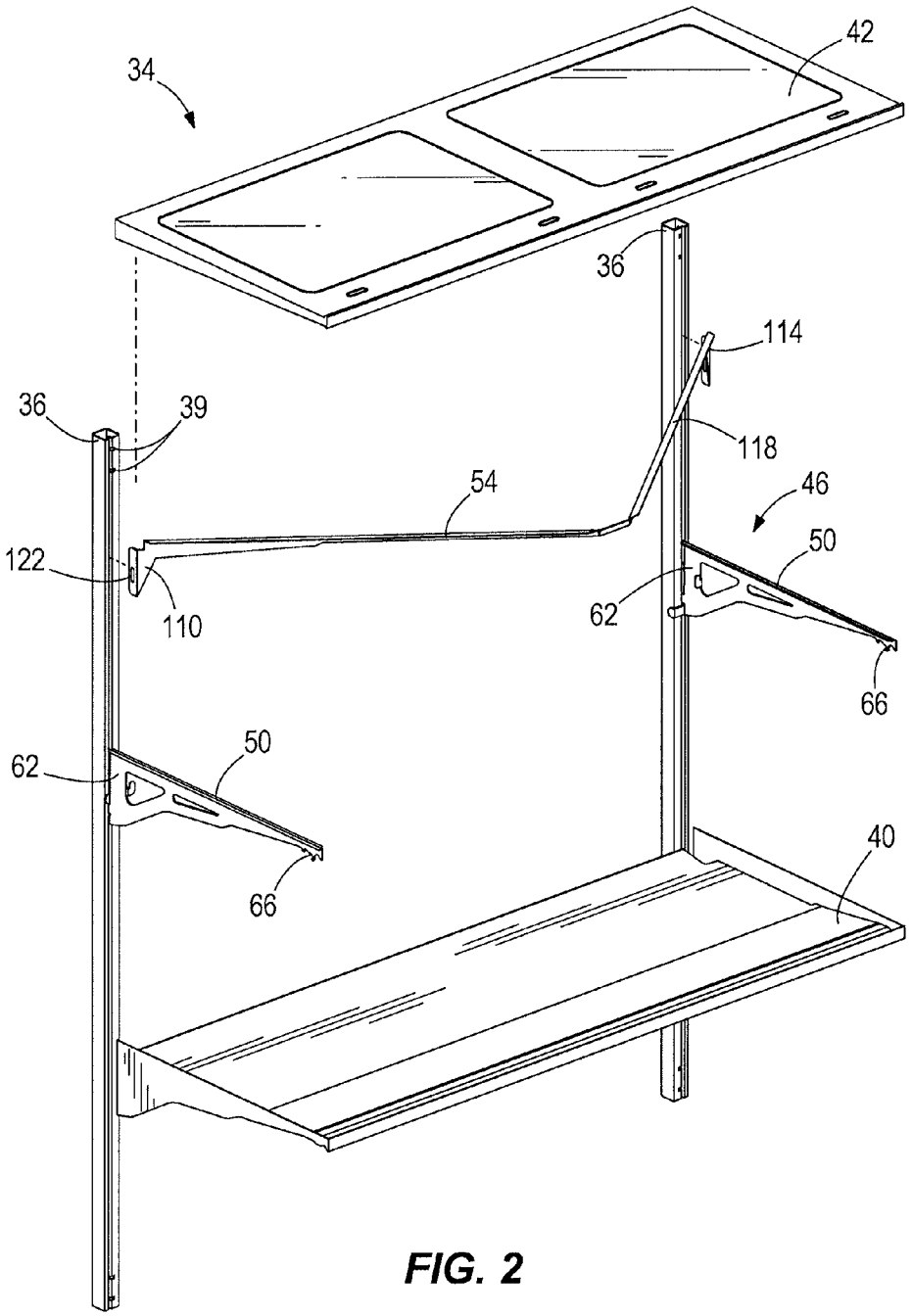
FIG. 2 is an exploded perspective view of a shelf and vertical standards supporting the shelf.
Figure 4:
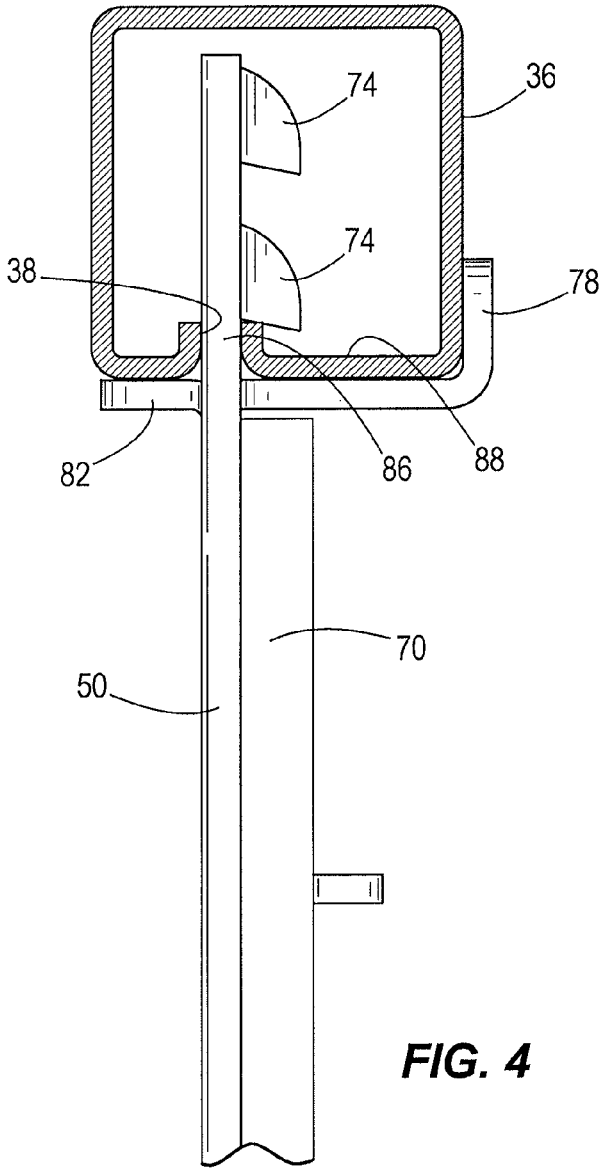
FIG. 4 is a top view of a portion of an end bracket coupled to a vertical standard.

Referring to FIGS. 1, 2, and 4, each shelf 34 is coupled to the rear wall 22 via shelf standards 36 that are attached or otherwise provided in a vertical orientation along the rear wall 22. Each shelf standard 36 is defined by a hollow tubular structure that has a vertical access channel 38 that is oriented to face into the product display area 30 when the shelf standard 36 is attached to the rear wall 22. Access slots 39 can be provided at upper and lower ends of the access channel 38, and possibly at one or more locations along the length of the standard 36, to permit attachment of the shelf 34 to the standard 36, as described in detail below.

The shelf 34 includes a lower shelf skin 40, an upper shelf skin 42, and a skeleton structure 46 that is sandwiched or trapped by the lower and upper shelf skins 40, 42. The lower shelf skin 40 defines a lower, exterior surface of the shelf 34, and the upper shelf skin 42 defines an upper surface of the shelf 34 that supports product. Generally, the lower and upper shelf skins 40, 42 can be shaped to accommodate specific product. As illustrated, the shelf skins 40, 42 are solid, although the shelf 34 can have other types of skins.

Figure 3:
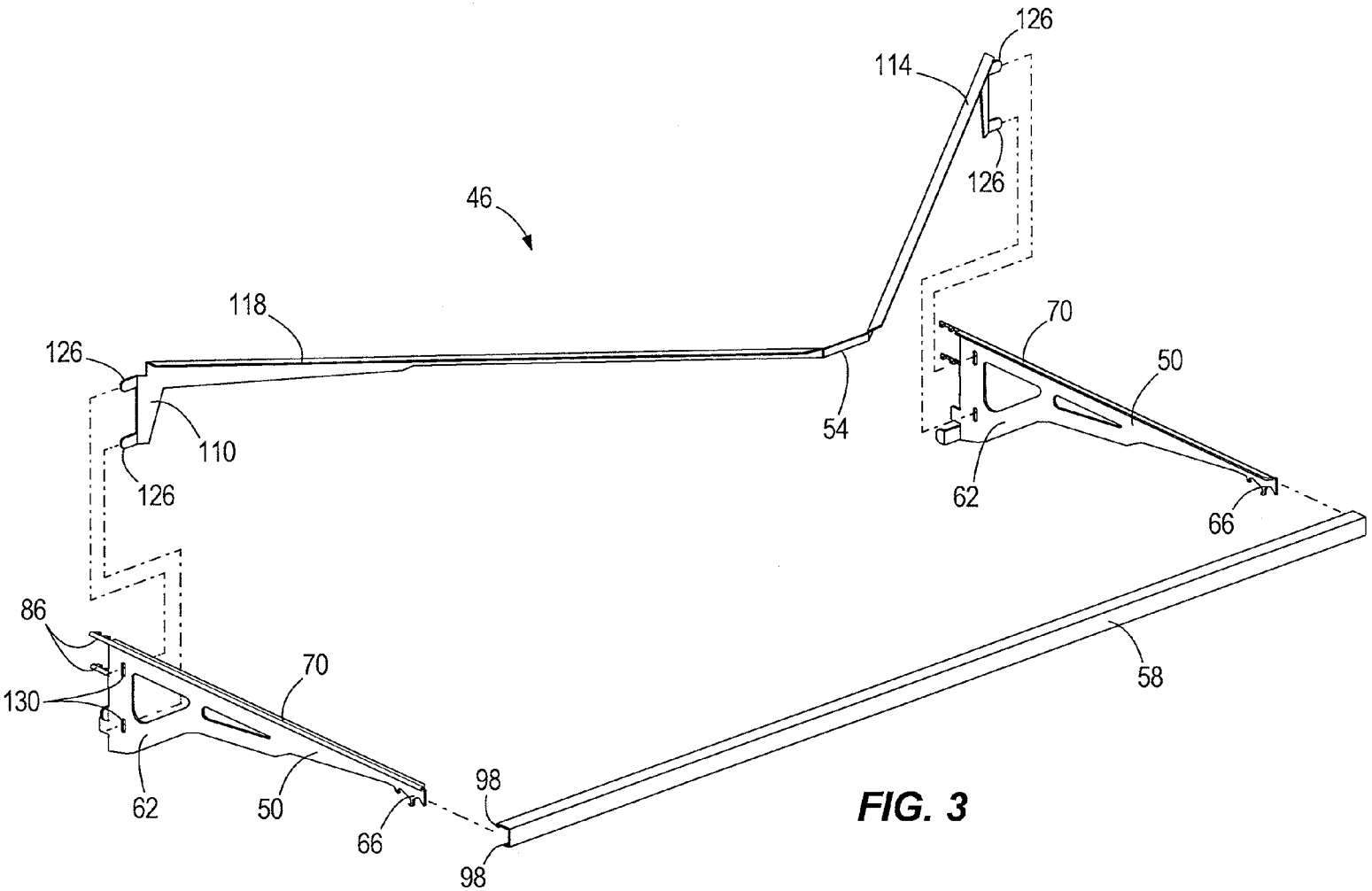
FIG. 3 is an exploded perspective view of a skeleton structure of the shelf of FIG. 2 illustrating end brackets, an intermediate bracket, and a cross bracket.

The skeleton structure 46 provides structural support to the shelf 34 to prevent the shelf skins 40, 42 from bowing when weight is applied to the shelf 34. With reference to FIG. 2, the skeleton structure 46 includes a pair of end brackets 50 and an internal or intermediate bracket 54. As illustrated in FIG. 3, the skeleton structure 46 can also include a front bracket 58 that extends across and is connected to distal ends of the end brackets 50 (e.g., to provide an attachment point for a light assembly, to provide additional structural support, etc.).

The illustrated skeleton structure 42 is formed of metal, although other materials can be used (e.g., composite, plastic, etc.). Generally, the skeleton structure 46 is substantially enclosed by the skins 40, 42 except in areas that define attachment points (e.g., to the shelf standards 36, to accommodate accessories such as light assemblies on the shelf 34, etc.). The skeleton structure 46 can be enclosed by the skins 40, 42 in one of several ways. For example, the skeleton structure 46 can be thermoformed in place using a twin sheet thermoforming process. In lieu of thermoforming, the skeleton structure 46 can be blow molded in place or foamed in place (e.g., using injected foam) between the two skins. Stated another way, the skeleton structure 46 can be adhered to the one or both skins 40, 42 by any suitable manufacturing process (co-molding, blow-molding, using injected foam, etc.) As will be appreciated, the skeleton structure 46 can be enclosed by the skins 40, 42 using other manufacturing processes.

By enclosing and capturing the skeleton structure 46 between the skins 40, 42, the shelf 34 is formed as an integral unit to increase the load carrying capabilities of the shelf 34 relative to existing shelves. The skeleton structure 46 can be sub-assembled (e.g., encapsulated by expanding polyurethane foam insulation) and inserted into a cavity between the skins, or the skeleton structure 46 can be formed between the skins 40, 42 during the manufacturing process that forms the skins 40, 42. In general, the skeleton structure 46 is captured and secured either directly or indirectly to the skins 40, 42.

As shown in FIGS. 2-5*d*, the end bracket 50 is a triangular-shaped support member that has a rearward end 62 engageable with one shelf standard 36 and a forward end 66 that defines a distal or cantilevered end of the bracket 50. Sides of the lower shelf skin 38 are formed to substantially enclose the end brackets 50 (e.g., to hide the end brackets 50 from view). The end bracket 50 is formed to include a substantially planar skin support 62 that is engaged with and supports the upper skin 42. The end bracket 50 also includes engagement members 74, an alignment member 78, and a stop member 82. The engagement members 74 are positioned along an extension 86 that projects rearward from the rearward end 62. As illustrated, the engagement members 74 are bent outward from the extension 86 and are engageable with the shelf standard 36 to attach the shelf 34 to the standard 36. More specifically, the access channel 39 is sized to receive the engagement members 74 so that the engagement members 74 can be positioned inside the vertical channel 38. The extension 86 is slidable along the vertical channel 38 so that the shelf 34 can be positioned at the desired height along the rear wall 22. As the extension 86 slides, the forward end 66 is held slightly above the rearward end 62 so that the alignment member 78 and the stop member 82 are held a short distance away from the standard 36. In this orientation, interference between the inner side of the shelf standard 36 and the engagement members 74 can be substantially avoided.

With reference to FIG. 4, when the shelf 34 is positioned at the desired height, the forward end 66 is lowered so that the engagement members 74 are engaged with an inner wall 88 of the shelf standard 36 to hold the shelf 34 in position and stabilize the end bracket 50 in the longitudinal direction (i.e. along the length of the end bracket 50 between the rearward end 62 and the forward end 66). The alignment member 78 is bent and partially wraps around an exterior corner of the shelf standard 36 to stabilize the end bracket 50 in the longitudinal and lateral directions. The stop member 82 is engageable with an exterior of the shelf standard 36 to assist with stabilizing the end bracket 50 in the longitudinal and lateral directions. As illustrated, the engagement members 74 are located adjacent the top of the end bracket 50, the alignment member 78 is located along the rearward end 62 at the bottom of the end bracket 50, and the stop member 82 is located along the rearward end 62 between the engagement members 74 and the alignment member 78.

Figure 5A:
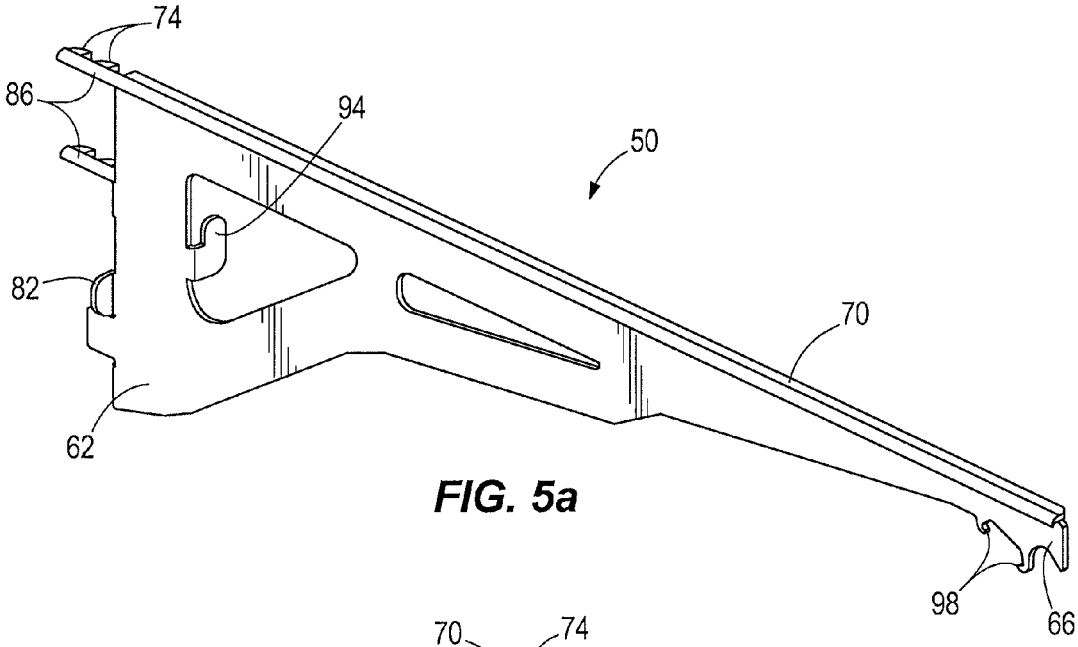
FIG. 5*a* is a perspective view of one end bracket illustrated in FIG. 2.
Figure 5B:
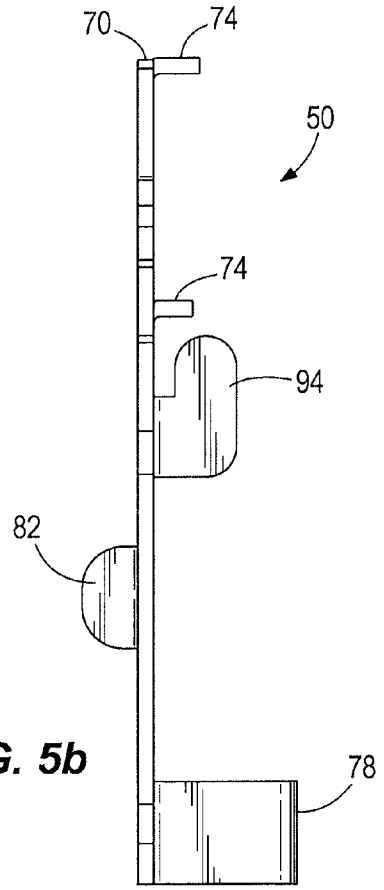
FIG. 5*b* is a front view of the end bracket of FIG. 5*a*.

With reference to FIGS. 5*a*-5*d*, the end bracket 50 also includes a hook member or flange 94 that is located a short distance from the rearward end 62, and light attachments 98 that are located adjacent the forward end 66. As illustrated in FIGS. 5*a* and 5*b*, the flange 94 is bent outward from the main body of the end bracket 50 along the side of the bracket 50 that faces the other end bracket 50. The flange 94 is shaped to attach the internal bracket 54 directly to the end bracket 50.

Figure 5C:
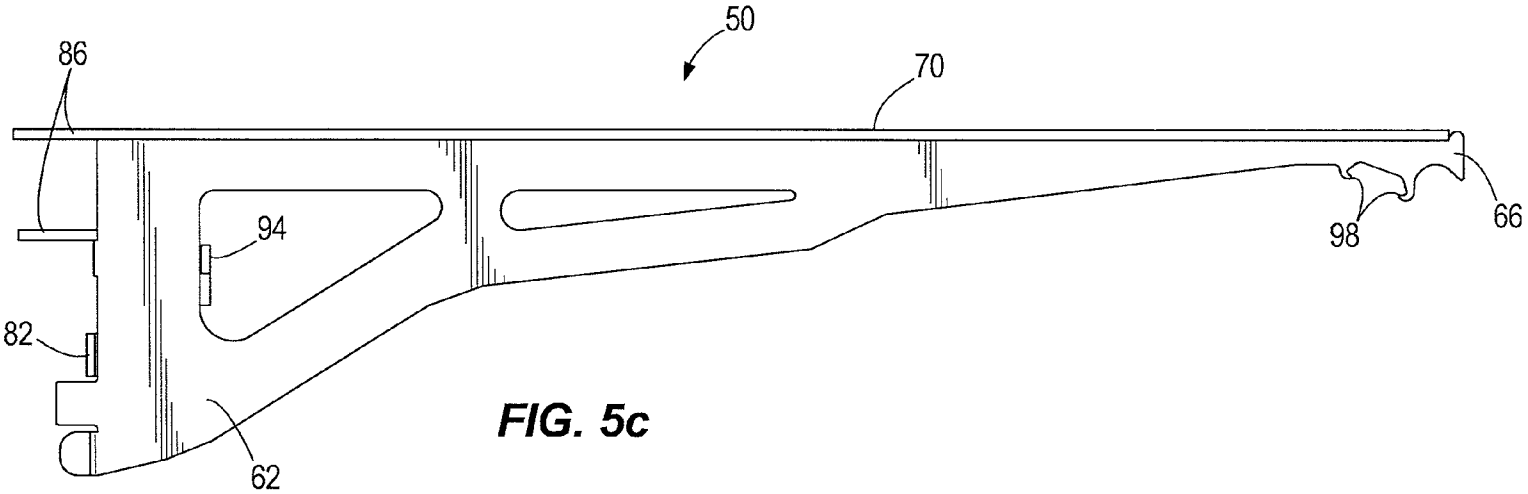
FIG. 5*c* is a side view of the end bracket of FIG. 5*a*.
Figure 5D:
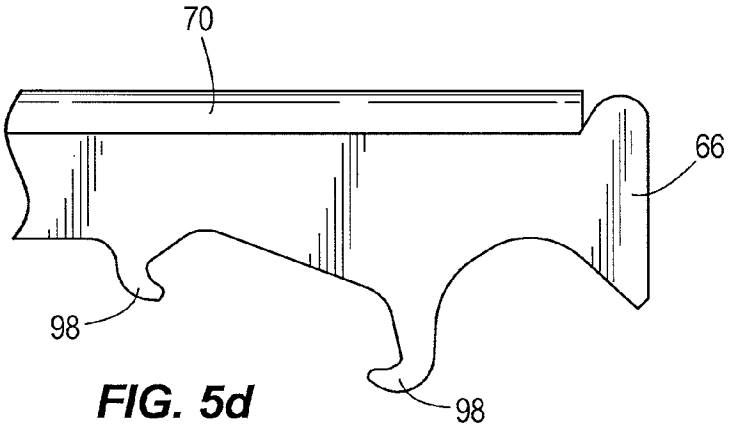
FIG. 5*d* is an enlarged side view of the end bracket of FIG. 5*c*.
Figure 6:
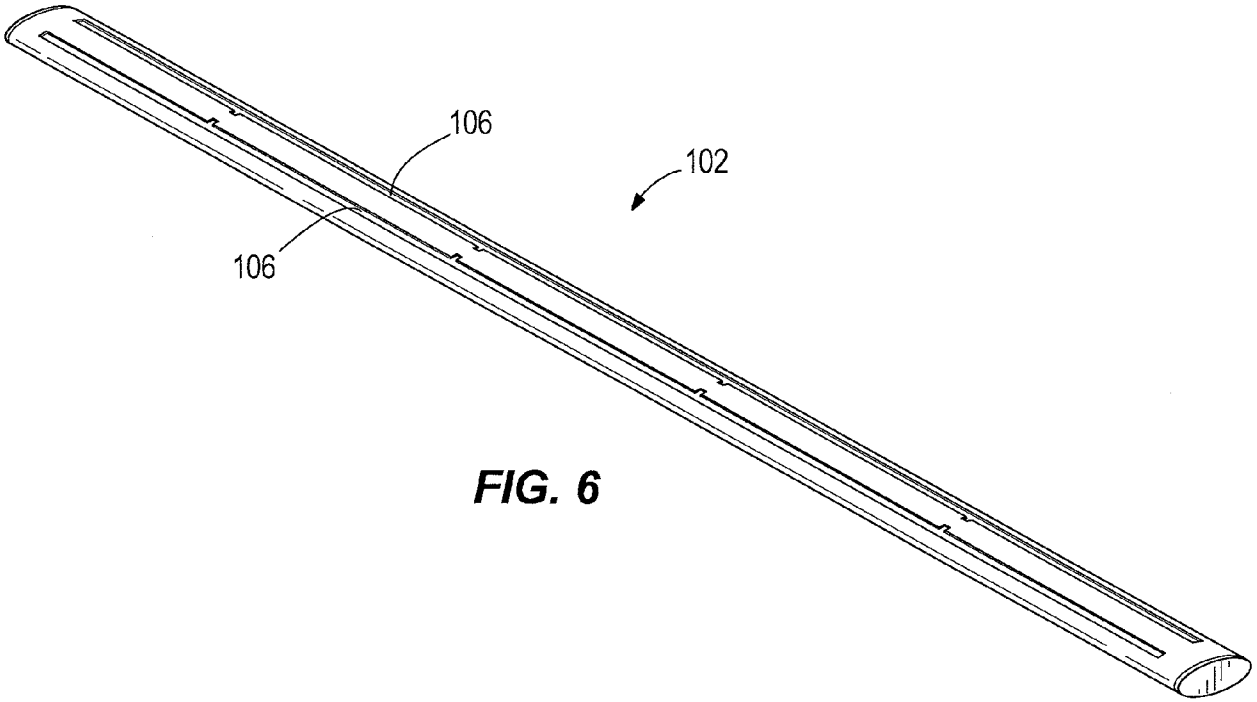
FIG. 6 is a perspective view of a light assembly that can be coupled to the shelf.

With reference to FIGS. 5*c*, 5*d*, and 6, the illustrated light attachments 98 are shaped as protrusions (e.g., in the form of hooks) that attach a light assembly 102 (e.g., an LED bar) to the shelf 34. The illustrated light assembly 102 has slots 106 that are engageable by the light attachments 98 to align and support the light assembly 102 on the shelf 34.

Referring to FIGS. 2 and 3, the internal bracket 54 includes a first end 110 that is coupled to one end bracket 50 and a second end 114 that is coupled to the other end bracket 50. The illustrated internal bracket 54 is bent adjacent a midway point along the length of the bracket 54 to define a substantially "V"-shaped support member that extends forward from each end bracket 50 toward a front of the shelf 34. As illustrated, the top of the internal bracket 54 is formed (e.g., bent) to include a planar surface 118 that supports the upper shelf skin 42.

With reference to FIG. 2, the first and second ends 110, 114 have holes 122 (one shown) that are engageable by the flanges 94 to attach the first and second ends 110, 114 to the respective end brackets 50. As illustrated in FIG. 3, the internal bracket 54 can be attached to the end brackets 50 by projections 126 that engage one or more holes 130 in the end brackets 50. As will be appreciated, the internal bracket 54 can be attached to the end brackets 50 adjacent the rearward end 62 in other ways. In some constructions, the internal bracket 54 can be attached directly to the shelf standards 36.

With reference to FIG. 3, the front bracket 58, when provided, defines a linear support member that is coupled to and extends between the forward ends 66 of the end brackets 50. In these constructions, the front bracket 58 provides additional structural support for the shelf 34 adjacent the front end. The front bracket 58 also can directly or indirectly support the light assembly 102. As illustrated, the forward-most portion of the internal bracket 54 is directly supported by the front bracket 58 to connect the brackets 50, 54, 58 to each other to provide rigidity to the shelf 34.

Figure 7:
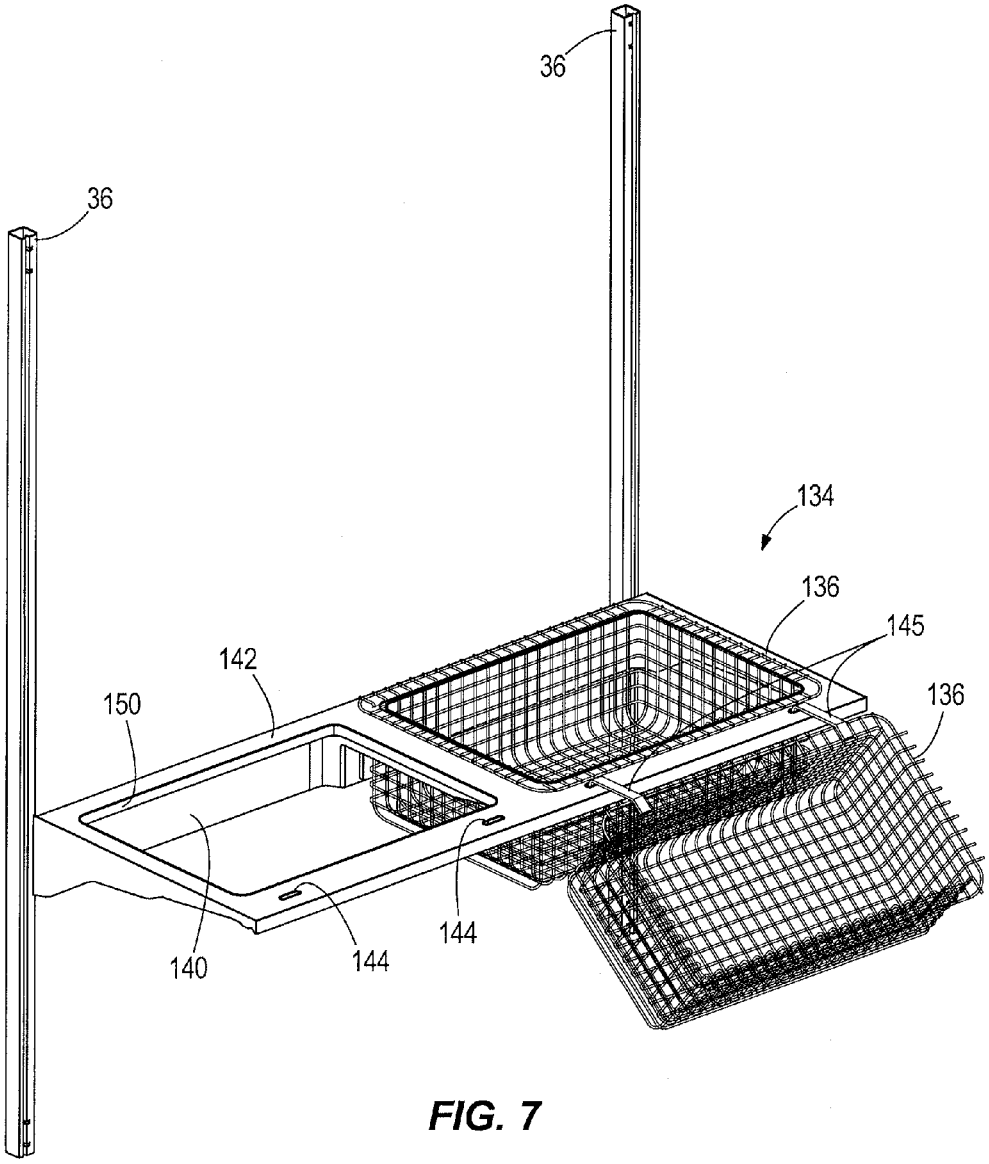
FIG. 7 is a perspective view of another shelf embodying the invention.
Figure 8:
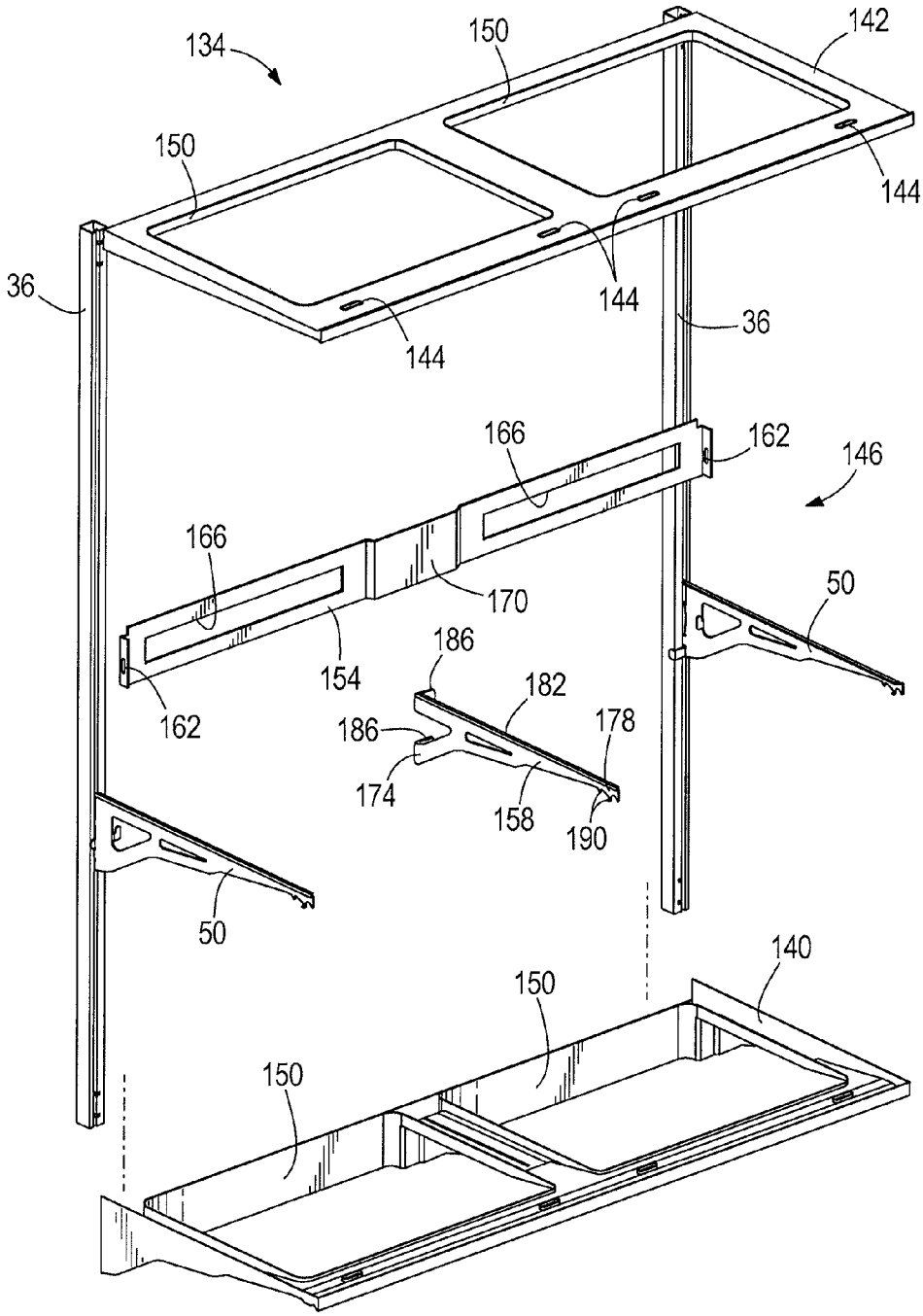
FIG. 8 is an exploded perspective view of the shelf of FIG. 7.

FIGS. 7 and 8 illustrate another construction of a shelf 134 that can be used with the merchandiser 10. Except as described below, the shelf 134 is the same as the shelf 34 described with regard to FIGS. 1-5*d*, and common elements are given the same reference numerals.

Referring to FIGS. 7 and 8, the shelf 134 supports baskets or product support holders or containers 136 (referred to as baskets for purposes of description) and includes a lower shelf skin 140, an upper shelf skin 142, and a skeleton structure 146 that is sandwiched by the lower and upper shelf skins 40, 42. Unlike the upper and lower shelf skins 40, 42 described above, the shelf skins 140, 142 have pockets 150 so that the baskets 136 can nest inside the shelf 134. As illustrated in FIG. 7, the upper shelf skin 140 has apertures 144 to receive supports 145 that attach additional baskets 136 to the front of the shelf 134.

As illustrated in FIGS. 7 and 8, the skeleton structure 146 provides structural support to the shelf 134 to prevent the shelf skins 140, 142 from bowing when weight is applied to the shelf 34. With reference to FIG. 2, the skeleton structure 146 includes the end brackets 50, a rear bracket 154 extending across a rear side of the shelf 134 between the end brackets 50, and an internal or intermediate bracket 154 that is attached to the rear bracket 154. Each end of the rear bracket 154 has a hole 162 that is engaged by the flange 94 to support the rear bracket 154 on the rearward ends 62 of the end brackets 50. In some constructions, the rear bracket 154 can be directly attached to the standards 36.

As illustrated in FIG. 8, the rear bracket 154 has two elongated openings 166 that are separated from each other by a plate section 170. The elongated openings 166 permit entry of conditioned air from within the merchandiser 10 into the product display area 30 directly below the shelf 34. As will be appreciated, the elongated openings 166 can have any desired shape, and in some constructions, can be modified to define a plurality of small openings or slits in the rear bracket 154.

The internal bracket 158 is a triangular-shaped support member including a rearward end 174 that is engageable with one the rear bracket 154, and a forward end 178 that defines a distal or cantilevered end of the bracket 158. The bracket 158 is formed to include a substantially planar skin support 182 that is engaged with and supports the central section or rib of the upper shelf skin 142. As illustrated, the internal bracket 158 is encapsulated by the central ribs of the lower and upper shelf skins 140, 142. The internal bracket 158 includes an attachment portion 186 that is positioned on the rearward end 174 and that is attachable to the rear bracket 154 (e.g., via fasteners, male-female connections, etc.). The forward end 178 has light attachments 190 that are the same as the light attachments 98.

Figure 9:
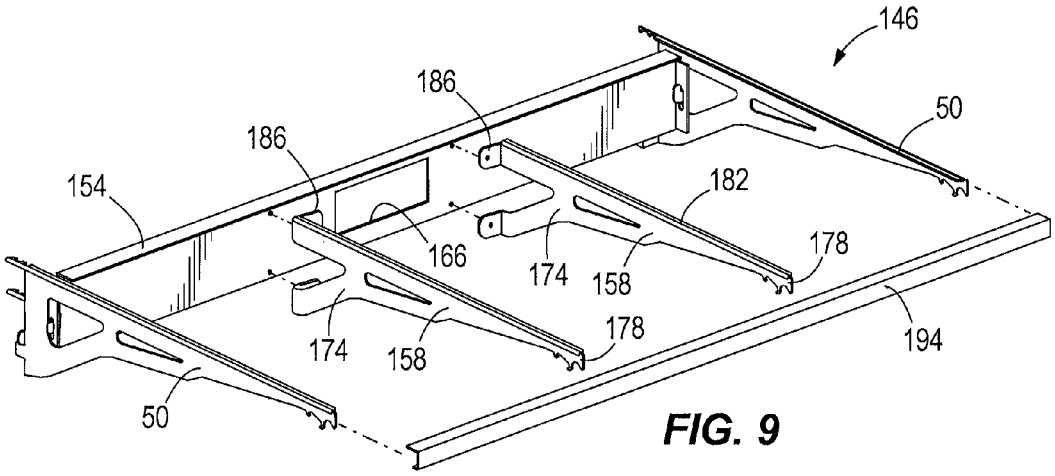
FIG. 9 is a partially exploded view of a skeleton structure of the shelf of FIG. 8.
Figure 10:
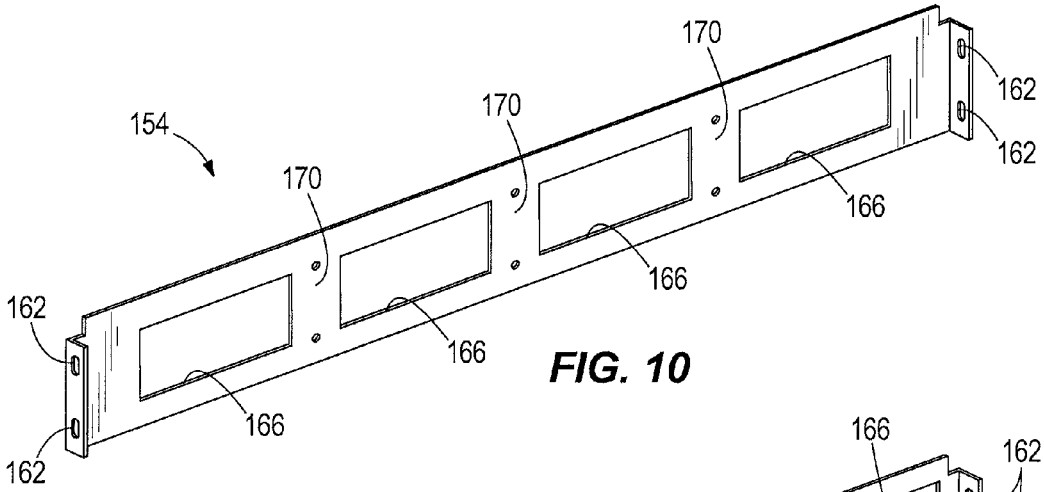
FIG. 10 is a perspective view of another rear bracket member for the shelf structure illustrated in FIG. 9.
Figure 11:
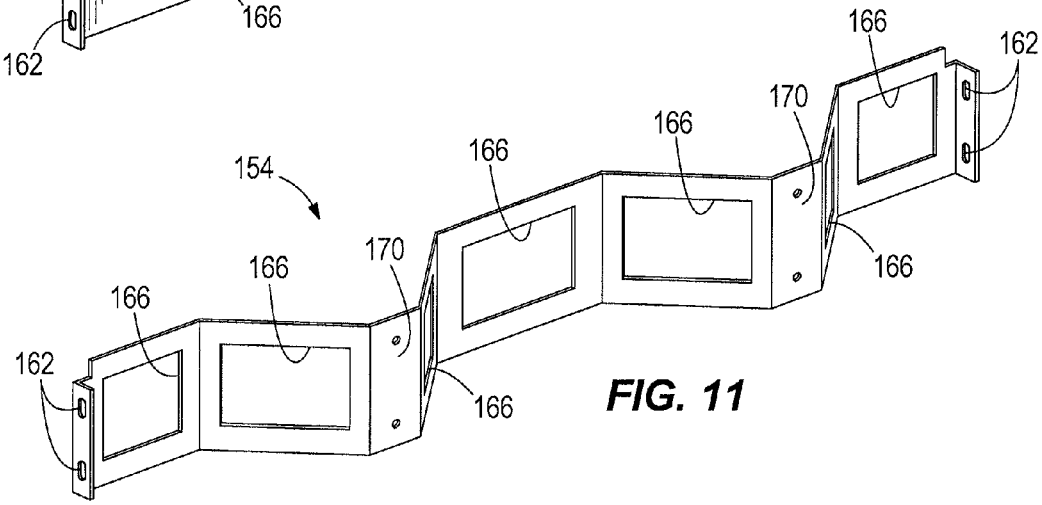
FIG. 11 is a perspective view of yet another rear bracket member for the shelf structure illustrated in FIG. 9.

As illustrated in FIG. 8, the skeleton structure 146 has one internal bracket 158 positioned between the end brackets 50. As shown in FIG. 9, the skeleton structure 146 can include two internal brackets 158 and an optional front bracket 194 that extends across and is connected to distal ends of the end brackets 50 and the internal brackets 158. More than two internal brackets 158 can be provided, if desired. Generally, the internal brackets 158 are oriented parallel to the end brackets 50 to support the central rib(s) provided on the upper shelf skin 142. With reference to FIGS. 10 and 11, the rear bracket 154 can include additional openings 166 and plate sections 170 depending in part on the quantity of internal brackets 158.

For example, FIG. 10 illustrates the rear bracket 154 including four openings 166 and three plate sections 170 to which one, two, or three brackets 158 can be attached. The rear bracket 154 illustrated in FIG. 10 is defined by a substantially planar plate member. As shown in FIG. 11, the rear bracket 154 includes six openings 166 and two plate sections 170 to attach one or two brackets 158 to the rear bracket 154. The rear bracket 154 illustrated in FIG. 11 is defined by a wavy pattern such that the plate sections 170 are spaced from the rear wall 22 when the shelf 134 is attached to the case 14. That is, the rear bracket 154 of FIG. 11 is defined by a non-planar plate member. The additional surface area provided by the non-planar rear bracket 154 can be utilized to provide additional airflow from the case 14 into the product display area 30 via the additional openings 166.

Generally, the internal bracket 54 transfers the moment force applied to the shelf 34 (stemming from weight applied to the shelf 134) to the end brackets 50, which in turn transfer the force or weight to the shelf standards 36 and the case 14. Similarly, the rear bracket 154 transfers the moment force that is absorbed by the internal bracket(s) 158 to the end brackets 50, which in turn transfer the force or weight to the shelf standards 36 and the case 14. By tying the internal bracket 54 directly into the end brackets 50 instead of to the standards 36, the shelf 34 has an increased stiffness and rigidity to withstand bowing. Likewise, by tying the internal brackets 158 directly to the rear bracket 154 and tying the rear bracket 154 directly to the end brackets 50, the shelf 134 has an increased stiffness and rigidity to resist bowing. In this manner, the load applied to the shelf 34, 134 is transferred and distributed to the end brackets 50.

The skeleton structure 46, 146 are substantially enclosed inside the shelf skins 40, 42, 140, 142 to provide a rigid structure and to provide a unitary shelf 34, 134 with a relatively small profile to minimize the visibility of the front edge of the shelf 34, 134 from a consumer's perspective from outside the merchandiser 10. By forming the shelves 34, 134 with polyurethane insulation between the skins 40, 42, 140, 142 and by forming the skins from an insulating material (e.g., a polymer) inhibits conductive heat transfer to the product being supported on the upper shelf skin 42, 142. Moreover, the skins 40, 42, 140, 142 can be formed to include a highly reflective surface (e.g., a very thin sheet of polymer or a polymer with a film laminated or co-extruded with the skins 40, 42, 140, 142) to increase light that impacts the product above and below the shelf 34, 134.

Various features of the invention are set forth in the following claims.

The invention claimed is:

1. A shelf for a merchandiser, the shelf comprising:

a skin defining a support surface of the shelf; and a skeleton structure to which the skin is attached, the skeleton structure including a first end bracket and a second end bracket spaced from and disposed opposite the first end bracket, the skeleton structure further including an internal bracket having a first end coupled to the first end bracket adjacent a rear end of the first end bracket and a second end coupled to the second end bracket adjacent a rear end of the second end bracket, wherein the internal bracket has a bend positioned between and spaced from the first end and the second end, and the internal bracket extends forward from the respective rear ends of the first end bracket and the second end bracket toward a front of the shelf, and wherein the bend is disposed adjacent the front of the shelf.

2. The shelf of claim 1, further comprising a bracket coupled to forward ends of the first and second end brackets, and wherein the internal bracket is coupled to the bracket adjacent the front of the shelf.

3. The shelf of claim 1, wherein the bend of the internal bracket defines the internal bracket as "V"-shaped.

4. The shelf of claim 1, wherein the skin is a first skin, the shelf further comprising a second skin, and wherein the skeleton structure is sandwiched by the first skin and the second skin.

5. The shelf of claim 4, wherein the skeleton structure is encapsulated by foam insulation prior to placement between the first skin and the second skin.

6. The shelf of claim 1, wherein the internal bracket and the first and second end brackets have complementary projections and holes to directly attach the internal bracket to the first and second end brackets.

7. The shelf of claim 1, wherein each of the first and second end brackets has an attachment positioned to attach a light assembly to the shelf.

8. A shelf for a merchandiser, the shelf comprising a support surface; and a skeleton structure including a first end bracket and a second end bracket spaced from and disposed opposite the first end bracket, the skeleton structure further including a front bracket coupled to and extending between forward ends of the first and second end brackets, and an internal bracket extending parallel to the first and second end brackets and coupled to the front bracket between the first and second end brackets, wherein the internal bracket is spaced apart from the first and second end brackets such that a gap is formed between the internal bracket and each of the first and second end brackets.

9. The shelf of claim 8, wherein the skeleton structure further includes a rear bracket extending between and coupled to the first and second end brackets.

10. The shelf of claim 9, wherein the rear bracket is directly attached to the first and second end brackets.

11. The shelf of claim 10, wherein the rear bracket defines an airflow opening disposed between the first and second end brackets.

12. The shelf of claim 10, wherein the rear bracket is defined by a non-planar shape having an airflow opening and a plate section positioned closer to a front of the skeleton structure than the airflow opening.

13. The shelf of claim 9, wherein the internal bracket is attached to the rear bracket and extends forward to the front bracket.

14. The shelf of claim 8, wherein the front bracket has an attachment positioned to attach a light assembly to the shelf.

15. The shelf of claim 8, further comprising a first skin defining the support surface of the shelf and a second skin disposed opposite the first skin, wherein the skeleton structure is encapsulated by the first skin and the second skin, and wherein the skeleton structure adhered to the first and second skins by one of the following processes: thermoforming, blow-molded, and co-molded.

16. The shelf of claim 15, wherein the internal bracket defines a planar support that is engaged with and supports a central section of the first skin.

17. The shelf of claim 15, wherein the skeleton structure is encapsulated by foam insulation prior to placement between the first skin and the second skin.

18. The shelf of claim 15, wherein the first skin defines at least one or both of a pocket disposed between lateral ends of the first skin to support a nested basket, and an attachment positioned adjacent a front edge of the skin to support a basket along the front edge.

19. A merchandiser comprising:

a case including a rear wall and a product display area partially defined by the rear wall; and a shelf coupled to the rear wall and including:

a skin defining a support surface of the shelf, and a skeleton structure adhered to the skin and including a first end bracket and a second end bracket spaced from and disposed opposite the first end bracket, the skeleton structure further including a rear bracket extending between and directly coupled to the first and second end brackets, and an internal bracket coupled to and extending forward from the rear bracket, wherein the internal bracket is spaced apart from the first and second end brackets such that a gap is formed between the internal bracket and each of the first and second end brackets.

20. The merchandiser of claim 19, wherein the skin defines at least one or both of a pocket disposed between lateral ends of the skin to support a nested basket, and an attachment positioned adjacent a front edge of the skin to support a basket along the front edge.

* * * * *